United States Patent [19]

Barton

[11] 4,142,799

[45] Mar. 6, 1979

[54] CORRECTION OF GUN SIGHTING ERRORS

[75] Inventor: Norman P. Barton, Egham, England

[73] Assignee: The Secretary of State for Defence in Her Britannic Majesty's Government of the United Kingdom of Great Britain and Northern Ireland, London, England

[21] Appl. No.: 775,695

[22] Filed: Mar. 9, 1977

[30] Foreign Application Priority Data

Mar. 16, 1976 [GB] United Kingdom ..... 10599/76

[51] Int. Cl.[2] ..... G01B 11/27; G02B 27/32

[52] U.S. Cl. ..... 356/153; 33/286; 356/247; 356/251

[58] Field of Search ..... 356/138, 152–154, 356/247, 251–254; 33/286, 233–234; 350/10, 20

[56] References Cited

U.S. PATENT DOCUMENTS

| | | | |
|---|---|---|---|
| 2,433,338 | 12/1947 | Brown | 350/20 |
| 2,633,051 | 3/1953 | Davis | 33/233 |
| 2,725,781 | 12/1955 | Banker | 356/251 |
| 3,684,383 | 8/1972 | Johansson | 356/138 |
| 3,951,553 | 4/1976 | Oberheuser | 356/251 |

FOREIGN PATENT DOCUMENTS

| | | | |
|---|---|---|---|
| 346752 | 2/1905 | France | 356/247 |

*Primary Examiner*—John K. Corbin
*Assistant Examiner*—Wm. H. Punter
*Attorney, Agent, or Firm*—Cushman, Darby & Cushman

[57] ABSTRACT

Apparatus for use in compensating for gun sighting errors due to misalignment between the muzzle axis of a gun and the optical axis of an associated gun sighting system is described, comprising a marker and a collimator mounted on the gun remotely from the muzzle and in fixed relation to one another, a reflector fixed to the muzzle portion of the gun barrel so as to be capable of reflecting into the collimator an uncollimated marker beam emanating from the marker, and means for defining an initial coincidence mark whose position is fixed in relation to the said optical axis so that after leaving the collimator the reflected marker beam can form a marker image superimposed upon the said initial coincidence mark, whereby any subsequent deviation of the muzzle axis from the said optical axis results in a corresponding movement of the marker image away from the initial coincidence mark.

10 Claims, 12 Drawing Figures

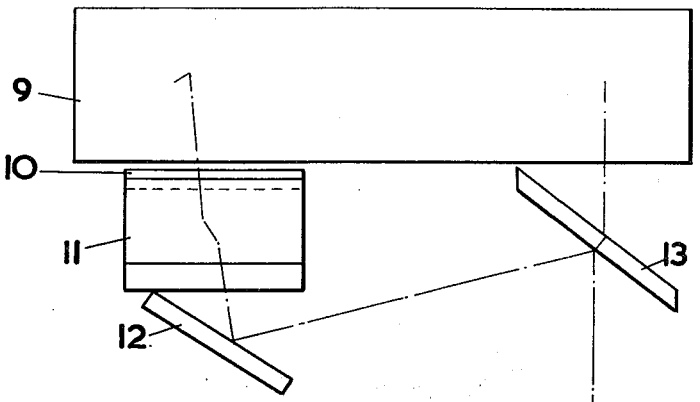
FIG. 9.
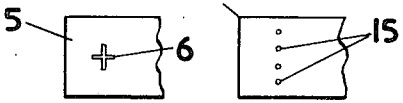
FIG. 10.
FIG. 11.
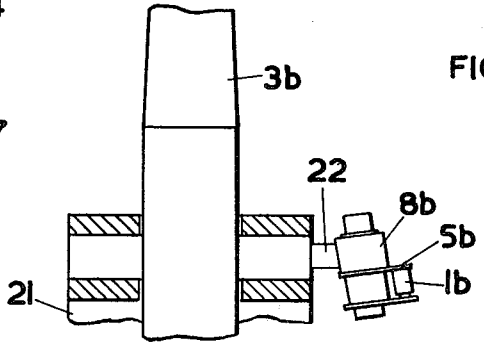
FIG. 7.
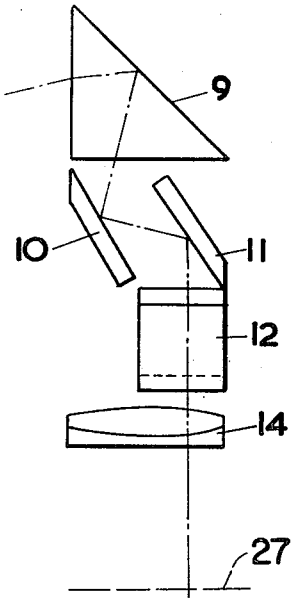
FIG. 8

CORRECTION OF GUN SIGHTING ERRORS

In gunnery for relatively short range firing, more particularly in fighting vehicle gunnery, the use of a muzzle boresight has been found to be a reliable means for aiming a gun for sight adjustment purposes. However, subsequent to firing a few rounds during a short period of time heating of the gun barrel results, and then conditions of rain or of a cold cross wind can cause bending of the gun barrel. In consequence an aim by sight, due to such bending, may fail to secure a hit on a target at say 1500 yards range. Sighting may also be subject to errors due to other causes such as movements of the gun in its cradle, to gun/sight linkage errors or backlash or to range drum or sight inaccuracies. An object of the invention is to provide means to facilitate compensation for one or more such errors.

According to the present invention, apparatus for use in compensating for gun sighting errors due to misalignment between the muzzle axis of a gun and the optical axis of an associated gun sighting system comprises a marker and a collimator mounted on the gun remotely from the muzzle and in fixed relation to one another, a reflector fixed to the muzzle portion of the gun barrel so as to be capable of reflecting into the collimator an uncollimated marker beam emanating from the marker, and means for defining an initial coincidence mark whose position is fixed in relation to the said optical axis so that after leaving the collimator the reflected marker beam can form a marker image superimposed upon the said initial coincidence mark, whereby any subsequent deviation of the muzzle axis from the said optical axis results in a corresponding movement of the marker image away from the initial coincidence mark.

The marker beam can be injected into the field of view of the sighting system and the marker image can be used as an aiming mark, as a reference for setting the sight graticule of the sighting system, or for getting a visual estimate of the bend or distortion of the gun barrel and of any other errors present. The apparatus of the invention is particularly useful in armoured fighting vehicles where the gun-layer's sight has a trunnion mounting at some distance from the gun trunnions and connected thereto by a parallelogram linkage.

Figure 1:
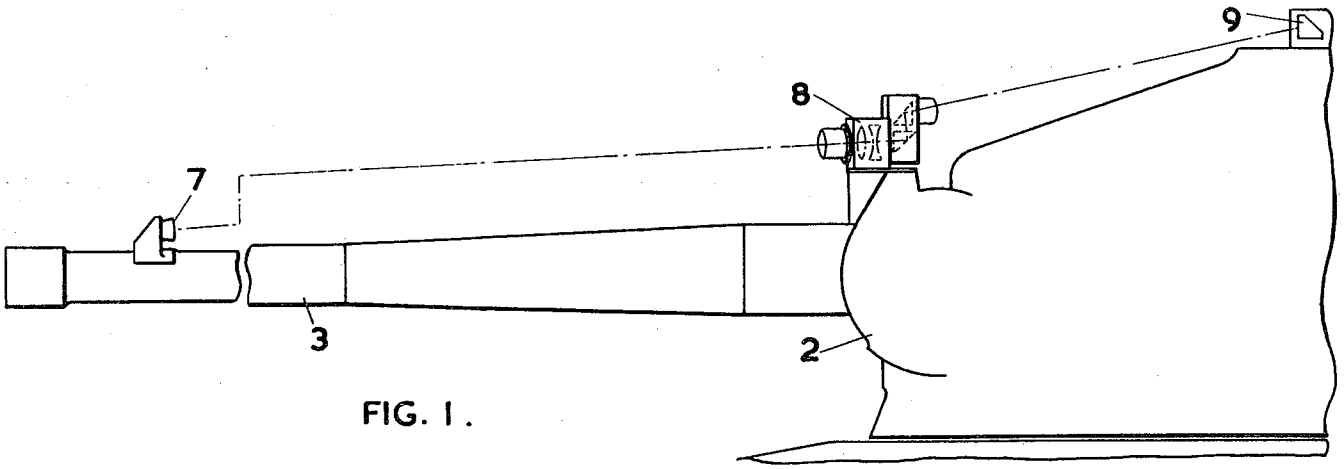
Figure 2:
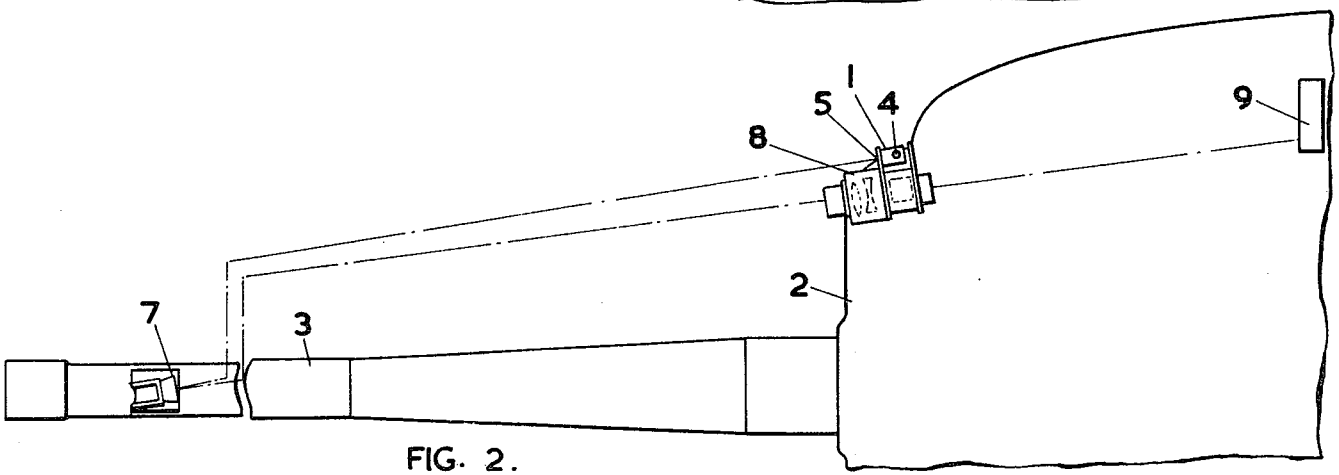
Figure 3:
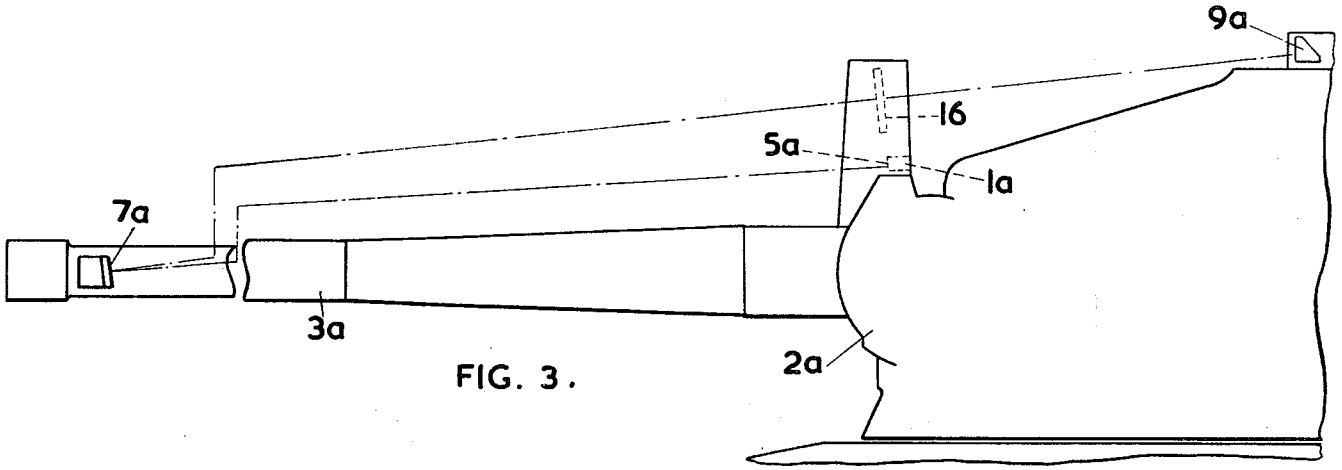
Figure 4:
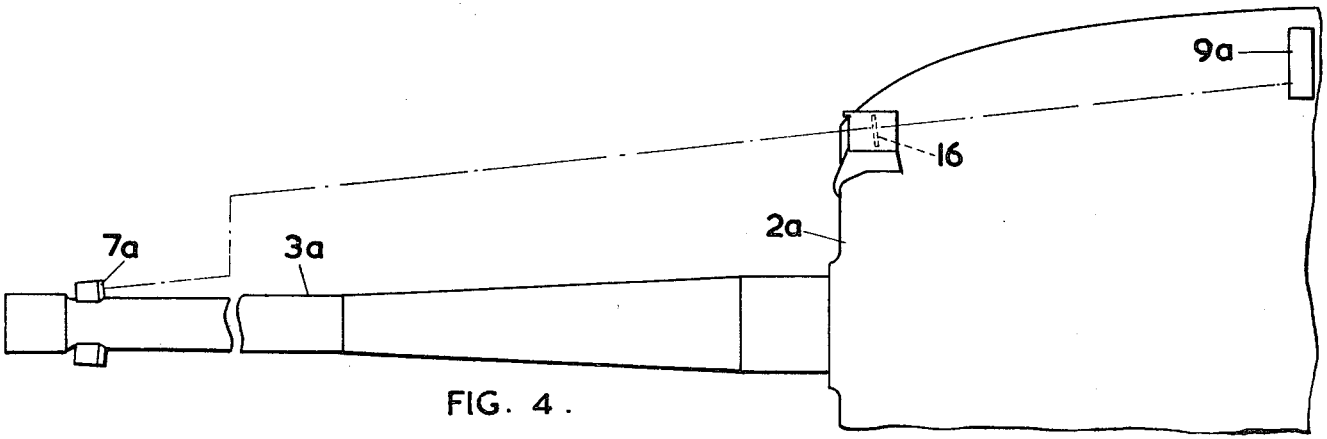
Figure 5:
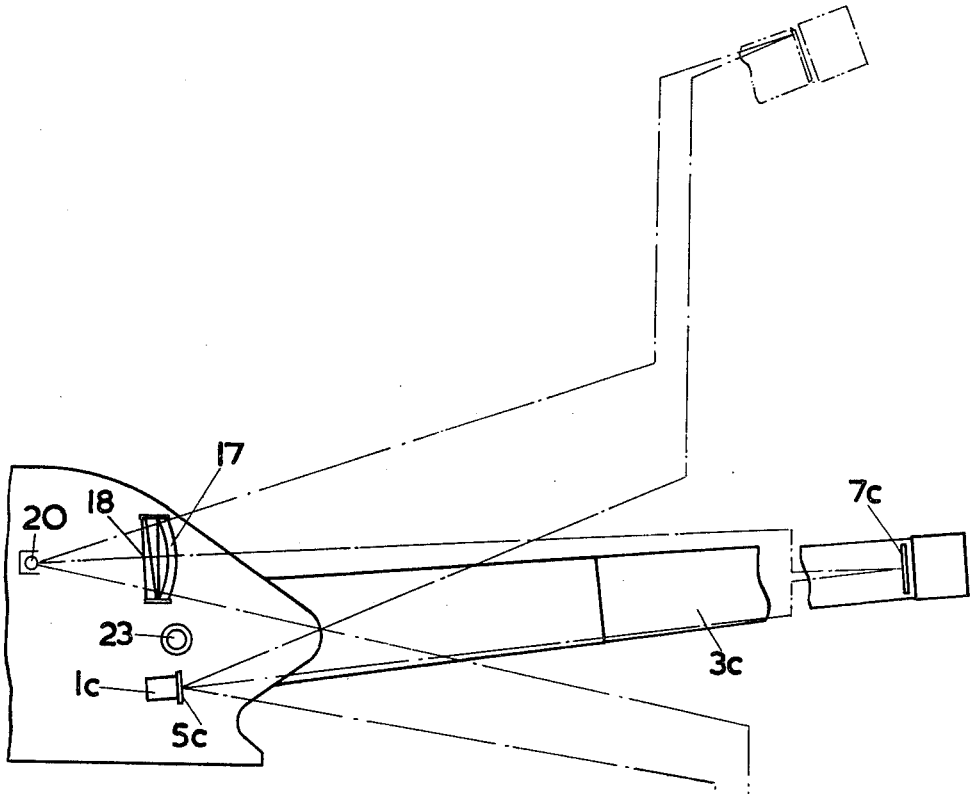
Figure 6:
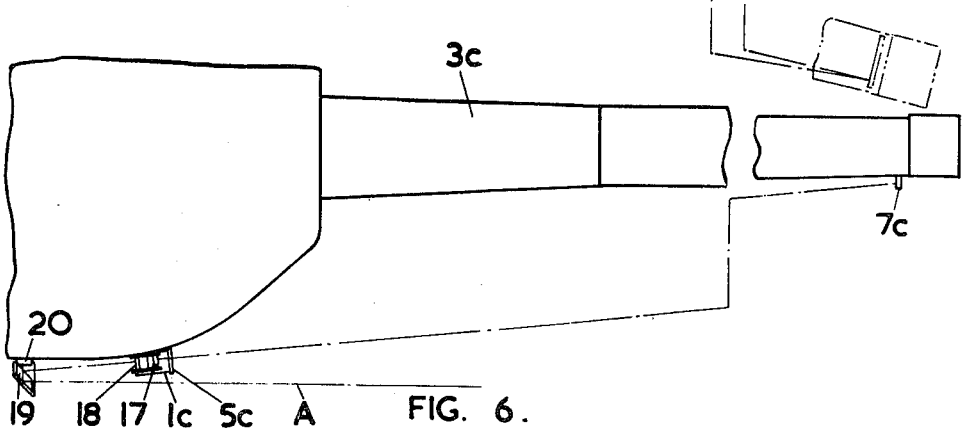
Figure 9A:
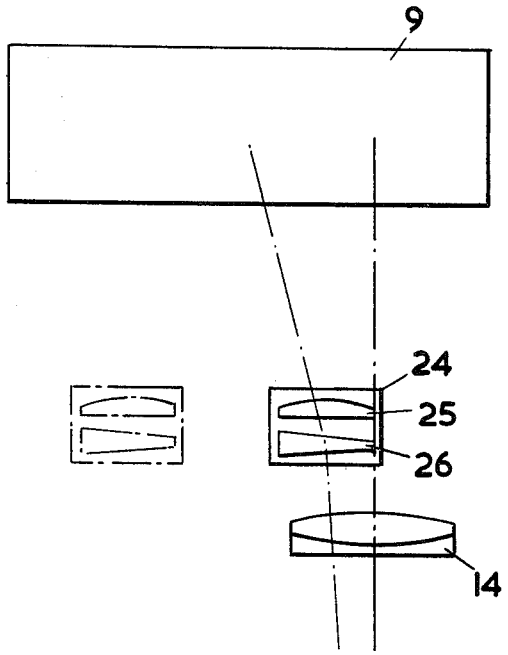

The invention is illustrated by way of example in the accompanying drawings in which FIG. 1 is a side elevation of a gun having associated therewith apparatus according to the invention, FIG. 2 is a plan view thereof, FIGS. 3 and 4 are respectively a side elevation and a plan view, similar to FIGS. 1 and 2, showing another form of apparatus according to the invention, FIGS. 5 and 6 are also side elevation and plan views respectively of a further form of apparatus according to the invention, FIG. 7 is a diagrammatic plan view of a further form, FIGS. 8 and 9 are diagrammatic views of an optical system for injecting images into the sighting optical system associated with a gun, FIG. 9A is a diagrammatic view of an alternative optical system for injecting images into the sighting optical system associated with a gun, and FIGS. 10 and 11 are front views of parts of front plates associated with light sources which can be employed as markers in apparatus according to the invention.

As shown in FIGS. 1 and 2 a casing 1 is mounted relative to the mantlet 2 of a gun 3. The casing 1 houses a source of illumination 4 and is provided with a front plate 5 having therein a slit 6 (FIG. 10) in the form of cross which serves as a marker.

A mirror or reflecting surface 7 is fixedly mounted at or adjacent to the muzzle of the gun in such a position that a light beam passing through the marker slit 6 is directed on to the mirror 7 from which the uncollimated beam is reflected to the lens of a collimator 8 which is also mounted on the gun mantlet 2, adjacent to and in fixed relationship with the marker front plate 5 and source of light 4. The collimated beam from the collimator is directed to a prism 9 in the sight head and from thence is received by a normal gun sighting optical system, e.g. as shown in FIGS. 8 and 9, in which it is fully reflected by way of mirrors 10, 11 and 12 and by a partial reflector 13 to the objective lens 14 of the magnifying system, so that an image of the marker is imposed on the sighting graticule 27 of the optical sighting system which thus serves to define an initial coincidence mark. The image of the marker may thus be viewed, together with the initial coincidence mark on the graticule through the eye lens of the sight simultaneously with viewing a distant target.

An alternative arrangement for injecting the reflected image from the muzzle mounted mirror into the gun sight system is shown in FIG. 9A. In this arrangement, the gun sight system comprises a prism 9 and a sight objective 14 as before, whence the target image is imposed on the sighting graticule (not shown) and may be viewed in the normal way through the magnifying system of the sight. The arrangement is such that the uncollimated marker beam emanating from a light source and marker adjacent to the sight is reflected from the muzzle mounted mirror and then also passes through the prism 9, but on an optical axis which is inclined to that of the gun sight. Interposed between the prism 9 and the objective 14 is a cell 24 comprising a collimating lens 25 and a deviating prism 26. The focal length of the lens 25 is twice the sight to mirror distance and the deviating prism is such as to bring the reflected marker beam into alignment with the optical axis of the sight. In use, the cell 24 is moved into the position shown in full lines in FIG. 9A when it is desired to check the alignment of the muzzle with the sighting graticule marks. At other times the cell 24 is moved to the position shown in dotted lines, in order that the target image as viewed through the sight is not obscured by the presence of cell 24. In a still further modification the collimating lens 25 and deviating prism 26 could be of small dimensions relative to the aperture of objective 14, and the cell 24 could then be left permanently in place without great loss of clarity or intensity of the target image.

When the gun barrel 3 is in its normal or undistorted condition, i.e. prior to firing, the gun can be sighted by the use of a muzzle bore-sight and the sighting graticule can be adjusted in position to bring its zero marking into coincidence with a distant target used for bore sighting. Thereafter, by suitable adjustment of the mirror system of the sighting device or of the collimating lens system the image of the marker can be brought into coincidence with the zero or other mark on the sight graticule, which therefore constitutes an initial coincidence mark. Any subsequent distortion or bending of the gun barrel will cause movement of the mirror 7 and consequent deviation of the marker image relative to the graticule of the sighting system whereby the marker image on the graticule will move out of register with the initial coincidence mark on the graticule scale. The direction and extent of such movement will be an indication of the direction and magnitude of distortion of the barrel.

By movement of the graticule of the sighting system (not shown) the initial coincidence mark on the graticule can again be brought into register with the image of the marker and this movement of the graticule will compensate for the distortion of the barrel if the next lay is made whilst this distortion persists.

According to a modified form of compensating means shown in FIGS. 3, 4 and 11, a gun 3*a* is provided with a mantlet 2*a* and has fixedly mounted thereon adjacent its muzzle a mirror 7*a*. Mounted on the mantlet is a casing 1*a* housing a source of illustration and having a front plate or dispositive 5*a* provided with a series of holes 15 therein (FIG. 11). These holes are arranged one above another and may be aligned vertically as shown or be inclined to the vertical or disposed substantially vertically in an arc. The light beam is reflected from the mirror 7*a* towards a simple collimating lens 16 fixedly mounted relative to the casing 1*a* and from the lens 16 the collimated beam of light passes to a prism 9*a* in the sight head of a gun optical sighting system to inject into the sighting system a number of illuminated dots emanating from the holes 15. Such collimating lens may, for example, have a focal length of 26 feet and may be of 6 inches diameter, the operative portion being a central vertical section of about 2 inches in width.

The gunner's sight would contain a ballistic graticule having a bore-sighting zero mark and a series of dots corresponding to the holes 15 and correctly positioned for aiming the gun at a number of elevations according to the number of holes 15 employed (4 shown) for striking targets at a like number of ranges using high velocity ammunition, it being understood that other markings to suit other ammunitions and/or guns could also be included. The illuminated spots are so positioned relative to one another that when seen as an image in the sight they can be brought into exact coincidence with the 4 dots on the sight graticule by using the adjustments of the mirror system in the sight. Any bending of the gun barrel would cause departure from this coincidence and use of one of the illuminated marks instead of the corresponding opaque mark on the sight graticule would make allowance for the bending of the gun and the other errors mentioned earlier.

As hereinbefore described a ballistic graticule is used. If, however, a range drum is employed the operation of the system is modified so that for each adjustment to compensate for barrel bend and other causes of error the range drum is brought to the zero position and correction is then made by the sight telescope graticule adjusting means to move the zero mark into coincidence with the injected image of the marker.

Although the apparatus, apart from the mirror reflecting the light source to the collimator, has been described as mounted on the mantlet, such apparatus may be mounted otherwise provided that it is maintained in a fixed position relative to the gun cradle 21. For example, as shown in FIG. 7, a unit consisting of a casing 1*b* with a front plate 5*b* and a collimator 8*b*, may be mounted on a trunnion extension 22 rotating with the gun barrel 3*b*.

A further modification of the invention as shown in FIGS. 5 and 6 may be employed if the vehicle has no mantlet. With such modification a light source and a light diffuser are housed in a casing 1*c* having a front plate 5*c* with marker slots or holes therein, the front plate 5*c* and a collimating lens 17 being positioned so that they lie in a plane passing through the axis of the gun trunnions 23 and are approximately equidistant from and on opposite sides of the axis.

The plane is perpendicular to the gun barrel axis when it is in the mid point of either its total elevation range or that part most useful tactically. The light source and collimating lens 17 are fixed to the turret in this position, and a mirror 7*c* is fixed at or adjacent to the muzzle of the gun barrel 3*c*. This arrangement ensures that the total distance from the front plate 5*c*. to the collimating lens via the mirror 7*c* at the gun muzzle remains very nearly constant (errors of several minutes can occur if this is not so). There is, however, an error equal to $$\frac{\left\{\begin{array}{l}[1 - \text{cosine of angle turned through by gun}] \times [\text{sum of} \\ \text{distances of lens and light source from gun trunnion axis}]\end{array}\right\}}{[\text{focal length of collimating lens}]}$$

radian, which causes the collimated beam to leave the lens more nearly parallel to the gun axis when the gun is either elevated or depressed from the mid position. It will be obvious that if lens and light source are both on the gun trunnion axis this error will be zero, but this cannot be arranged if the lens is on the line 'sight to muzzle mirror' and the constant total distance condition mentioned above is also satisfied. This error can be eliminated almost perfectly by introducing a prism 18 of suitable deviation behind the collimating lens 17 of which only the essential central vertical section or slice is provided; the aperture of the prism being the same as that of the collimating lens. This prism is fixed on the same mounting as the lens so that when the gun is in the mid point of the elevation range as described previously the collimated beam enters the prism at the angle for minimum deviation, the direction of this deviation being such as to increase the angle between the collimated beam and the gun, normal to the trunnion axis. Any change in elevation of the gun (up or down) will cause the collimated beam to pass through the prism at an angle other than that for minimum deviation, hence there will be a larger deviation. Choice of a suitable value for the deviation of the prism will ensure that this increase is almost precisely equal to the error mentioned above. Light passing through the prism 18 is directed on to the upper or front face of an optical block 19 from which it is reflected into a telescope 20 incorporated in an optical sighting system. The lower or rear face of the optical block is silvered and receives and reflects into the telescope 20 a view of the target the line of sight of which is indicated at A.

Calculations and experimental work show that in a proposed vehicle design where the light source and collimator would be separated by about 14 inches vertical displacement and the mirror is 16 feet from them, a 1 degree deviation prism reduces an error of up to 4 minutes to less than 5 seconds at all points of an elevation range of 30 degrees. In this case, due to the short distance between gun and sight trunnions, operation throughout the angle of 30 degrees is possible with a lens of 8 inches in height. The prism of one degree deviation would be achromatic.

In the embodiments of the invention so far described, the method of operation has been to produce a directly observable indication of the misalignment between the gun muzzle and the sight. This indication can then be used as the basis for the correction of such misalignment. However, it will be apparent that other methods are within the scope of the invention, for example methods employing a position sensitive photoelectric detector upon which the image of the marker can be formed. Any misalignment could then be measured electrically to give a direct readout of its magnitude and/or direction; or to be fed into a computer for collation with other gun sighting errors; or to provide a signal to drive a servo controlled system to restore alignment automatically.

In principle, any of the embodiments described can function with a photo-electric detector instead of by direct visual observation of the marker image. However, photo-electric detectors require a certain minimum intensity of illumination for satisfactory operation, which may be greater that that of an adequate visual system. For this reason it will generally be more convenient to provide an entirely separate optical system for the photo-electric detection of sight to muzzle misalignment.

In one arrangement the photo-electric detector is carried on the same mounting as the sight graticule, so that, following initial adjustment of the gun to sight alignment (e.g. by a boresighting procedure) and subsequent bringing into coincidence of the position sensitive detector with the marker image, any later departure from this coincidence would be detected by the photo-electric detector. Restoration of this coincidence using any of the means described would then correct any error due to subsequent misalignment of the gun and sight.

I claim:

1. Apparatus for use in compensating for gun sighting errors due to misalignment between the muzzle axis of a gun and the optical axis of an associated gun sighting system comprising a marker and a collimator mounted on the gun remotely from the muzzle adjacent to each other and in fixed relation to one another, a reflector fixed to the muzzle portion of the gun barrel so as to be capable of reflecting into the collimator an uncollimated marker beam emanating from the marker, and means for defining an initial coincidence mark whose position is fixed in relation to the said optical axis so that after leaving the collimator the reflected marker beam can form a marker image superimposed upon the said initial coincidence mark, whereby any subsequent deviation of the muzzle axis from the said optical axis results in a corresponding movement of the marker image away from the initial coincidence mark.

2. Apparatus according to claim 1 comprising injection means for injecting the reflected marker beam into the field of view of the sighting system.

3. Apparatus according to claim 2 wherein the said injection means comprises a partial reflector located in the field of view of the sighting system, whereby the marker image and the image of a distant target can be viewed simultaneously through the sighting system.

4. Apparatus according to claim 2 wherein the said injection means comprises a deviating prism through which the reflected marker beam can be passed.

5. Apparatus according to claim 4 wherein the deviating prism is of small dimensions relative to the aperture of the sighting system and is permanently located in the field of view thereof.

6. Apparatus according to claim 4 wherein the deviating prism is contained in a moveable cell which can be located in the field of view of the sighting system when desired to check the alignment between the muzzle axis and the said optical axis, and can be removed from the said field of view at other times.

7. Apparatus according to claim 1 wherein the gun has a barrel mounted for elevation by rotation about an elevation axis, the marker and the collimator being mounted in a plane passing through the elevation axis and on opposite sides of and substantially equidistant from the said elevation axis, the said plane being perpendicular to the gun barrel axis when the gun barrel is in the mid point of its total elevation range.

8. Apparatus according to claim 7 wherein a deviating prism is provided adjacent the collimator in the path of the reflected marker beam.

9. Apparatus according to claim 1 wherein the marker is provided by a source of illumination within a housing, said housing having a front plate formed with a marker aperture.

10. Apparatus according to claim 9 wherein the front plate is formed with a plurality of marker apertures corresponding to range marks on a ballistic graticule of the gun sighting system.

* * * * *